US006640582B2

(12) United States Patent
Incorvia et al.

(10) Patent No.: US 6,640,582 B2
(45) **Date of Patent: *Nov. 4, 2003**

(54) SELF-RETAINING ELONGATED ADSORBENT UNIT

(75) Inventors: Samuel A. Incorvia, North Tonawanda, NY (US); Peter R. Millen, Perry, NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/193,420

(22) Filed: Jul. 11, 2002

(65) Prior Publication Data

US 2002/0174676 A1 Nov. 28, 2002

Related U.S. Application Data

(63) Continuation of application No. 09/751,342, filed on Dec. 29, 2000, now Pat. No. 6,449,977.

(51) Int. Cl.[7] ..... F25B 43/00; B01D 24/00

(52) U.S. Cl. ..... 62/474; 62/475; 210/287

(58) Field of Search ..... 62/474, 475, 512, 62/509, 292, 195; 210/287, 282, 348, 446; 55/428, 429

(56) References Cited

U.S. PATENT DOCUMENTS

| | | | | |
|---|---|---|---|---|
| 4,116,649 | A | | 9/1978 | Cullen et al. |
| 5,379,833 | A | | 1/1995 | Mathews |
| 5,419,141 | A | | 5/1995 | Burk |
| 5,546,761 | A | | 8/1996 | Matsuo et al. |
| 5,582,027 | A | | 12/1996 | Baba et al. |
| 5,709,106 | A | | 1/1998 | Inaba et al. |
| 5,713,217 | A | | 2/1998 | Baba |
| 5,813,249 | A | * | 9/1998 | Matsuo et al. ..... 62/509 |
| 5,824,140 | A | | 10/1998 | Berger |
| 6,170,287 | B1 | | 1/2001 | Leitch et al. |

FOREIGN PATENT DOCUMENTS

| | | | |
|---|---|---|---|
| JP | 07180930 | A | 7/1995 |
| JP | 08110125 | A | 4/1996 |
| JP | 2000283605 | A | 10/2000 |

* cited by examiner

*Primary Examiner*—Chen Wen Jiang
(74) *Attorney, Agent, or Firm*—Joseph P. Gastel

(57) ABSTRACT

A self-retaining adsorbent unit for use in combination with an elongated refrigerant-containing housing includes an elongated adsorbent-carrying porous fabric casing with adsorbent disposed therein. A retaining tab is formed at one end of the casing.

18 Claims, 7 Drawing Sheets

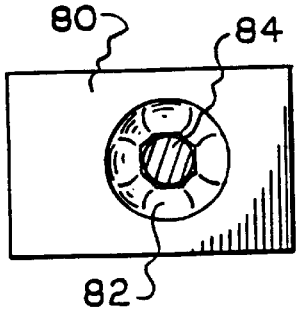
FIG. 10
FIG. 11
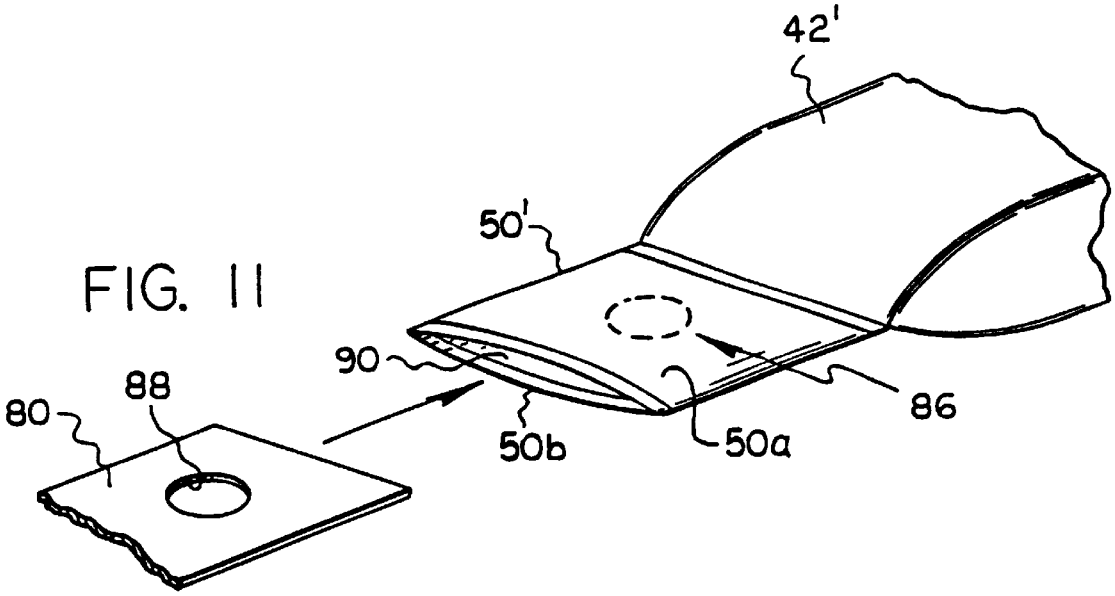
FIG. 12
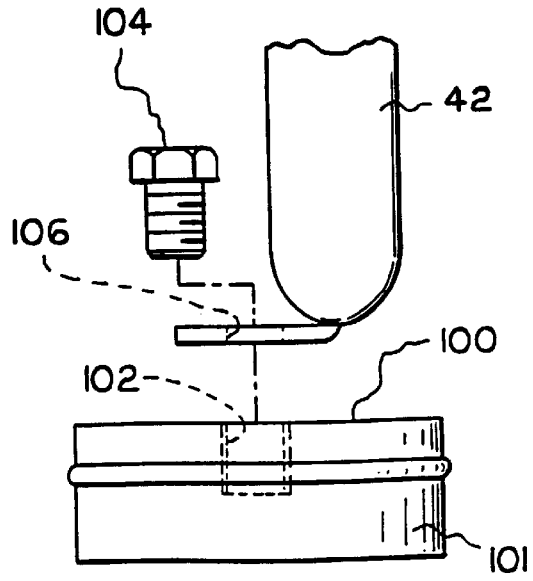

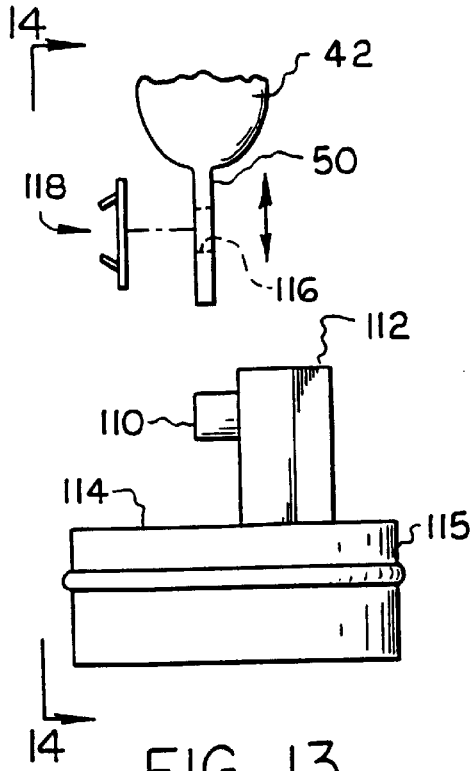
FIG. 13
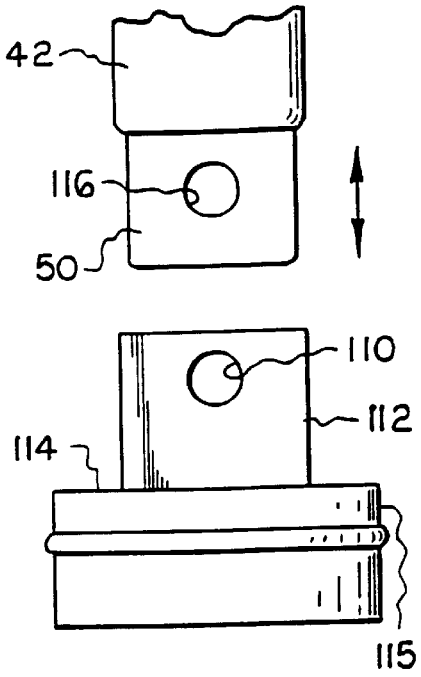
FIG. 14
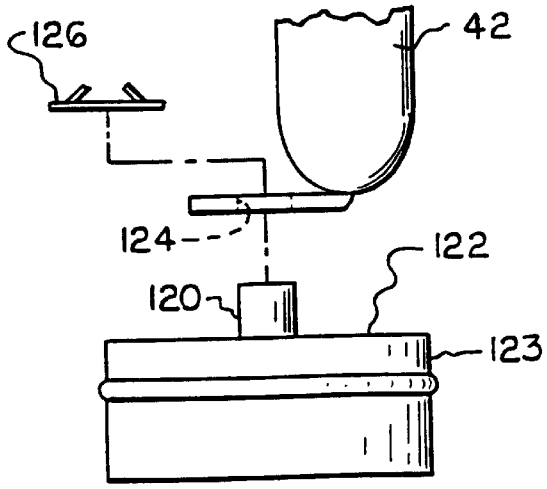
FIG. 15
FIG. 16
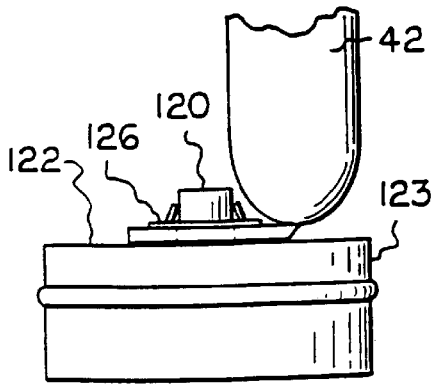

SELF-RETAINING ELONGATED ADSORBENT UNIT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a self-retaining elongated adsorbent unit especially suited for removable installation in an elongated receiver integrated with a refrigerant condenser.

In refrigerant receivers, especially those designed for integration with refrigerant condensers, the receiver is generally an elongated housing having a length-to-width ratio of at least about 6:1. Adsorbent is typically placed in the narrow interior of such housings in a manner that renders it difficult to remove and replace the adsorbent. Also, the absorbent should generally be restrained against movement during refrigeration operations. In some designs, the adsorbent is packed into a fixed chamber that is formed in a medial section of the receiver housing. The adsorbent is restrained against movement but removal and replacement of the absorbent requires disassembly of the receiver. In other designs, an elongated fabric sleeve is packed with absorbent and placed inside an elongated cage, which is then inserted into the receiver housing. The absorbent-containing sleeve is trapped inside the cage to prevent movement of the sleeve relative to the cage. Spring clips or bayonet connections are used to fix the cage against movement relative to the receiver housing. A threaded cap at the top of the receiver housing can be removed to allow retrieval of the adsorbent-containing cage. In order to be able to freely retrieve the cage from the receiver against the force of the retaining devices, a clip or other device is preferably formed on the upper end of the cage to receive a manually operated hooking tool. This complicates the removal and replacement of adsorbent. It is with overcoming deficiencies such as those described above that the present invention is concerned.

BRIEF SUMMARY OF THE INVENTION

It is an object of the present invention to provide an elongated absorbent unit for an integrated receiver housing of a condenser with the adsorbent unit being substantially fixed against movement during refrigeration operations yet easily retrieved for removal and replacement of the adsorbent.

Another object of the present invention is to provide an elongated absorbent unit for an elongated integrated receiver of a condenser which does not require an enclosing structure.

A further object of the present invention is to provide an elongated absorbent unit for an elongated receiver that maintains a self-sustaining elongated shape during refrigeration operations.

In a first aspect, the present invention relates to self-retaining adsorbent unit in combination with an elongated integrated receiver of a condenser having a length-to-width ratio of not less than about 6:1. The adsorbent unit includes an elongated adsorbent-carrying porous fabric casing that itself has a length-to-width ratio of not less than about 6:1. Adsorbent is disposed in the casing. A retaining tab is formed at one end of the casing for securing the adsorbent unit to an external structure. In another aspect, the casing is elongated in a substantially cylindrical configuration throughout its length. In a further aspect, the retaining tab has a width throughout its length that is substantially equal to the diameter of the casing. In a still further aspect, the adsorbent is packed sufficiently tightly within the casing to cause the adsorbent unit to be self-sustaining in its substantially cylindrical configuration.

BRIEF DESCRIPTION OF THE SEVERAL VIEWS OF THE DRAWING

The various aspects of the present invention will be more fully understood when the following portions of the specification are read in conjunction with the following drawing figures wherein:

FIG. 5' is a cross-sectional view taken along line 5'—5' in FIG. 5;

FIG. 5" is a cross-sectional view taken along line 5"—5" in FIG. 5;

FIG. 5'" is a cross-sectional view taken along line 5'"—5'" in FIG. 5;

FIG. 10 is a bottom view of a connecting member of FIG. 8, taken substantially in the direction of arrows 10—10 in FIG. 8;

FIG. 11 is an exploded perspective view showing the retaining tab approaching the end cap to form another type of connection between the retaining tab and the end cap;

FIG. 12 is a side elevational view showing another type of connection between the retaining tab and the end cap;

FIG. 13 is a side elevational view showing the retaining tab approaching the end cap to form another connection between a retaining tab and the end cap;

FIG. 14 is a view taken substantially in the direction of the arrows 14—14 of FIG. 13;

FIG. 15 is an exploded side elevational view showing another type of connection between the retaining tab and the end cap;

FIG. 16 is a side elevational view showing the connection of FIG. 15 in an assembled configuration;

DETAILED DESCRIPTION OF THE INVENTION

Figure 1:
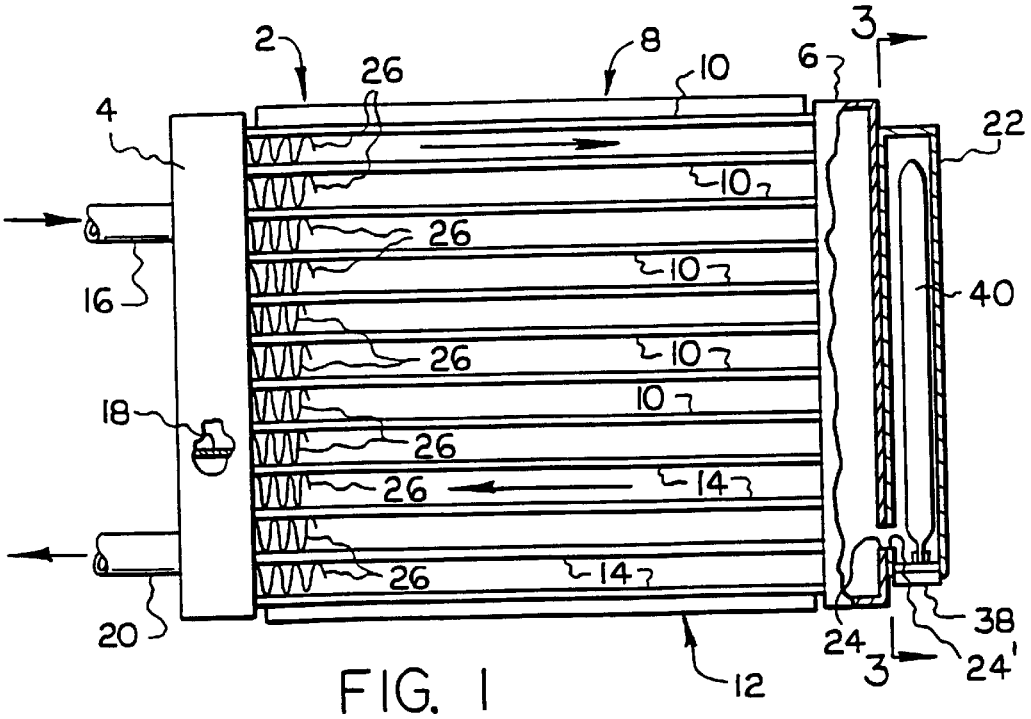
FIG. 1 is a front elevational view of a refrigerant condenser with an integrated receiver, with the receiver and a portion of the condenser being broken away to show a cross-section thereof taken along the axial centerline of receiver.

Turning now to the FIG. 1, a condenser 2 for condensing and cooling a refrigerant is shown in order to illustrate one possible environment in which the present invention could be implemented. The condenser 2 includes a pair of upright hollow headers 4 and 6 interconnected by a condensing core 8 comprising a plurality of hollow refrigerant transfer tubes 10, and a supercooling core 12 comprising a plurality of hollow refrigerant transfer tubes 14. An inlet side of the header 4 includes an inlet 16 that receives high temperature, high pressure gaseous refrigerant from a compressor (not shown). A separator plate 18 separates the incoming gaseous refrigerant from the outlet side of the header 4, which includes an outlet 20. The incoming gaseous refrigerant travels from the inlet 16 through the upper portion of the header 4 into the refrigerant transfer tubes 10 of the condensing core 8. Heat exchange occurs as the gaseous refrigerant passes through the refrigerant transfer tubes 10, such that the refrigerant exits into the header 6 in a condensed partially gaseous/partially liquid phase. The refrigerant travels down the header 6 and enters an elongated receiver 22 through a transfer passage formed by matching openings 24 and 24' respectively formed in opposing sidewall portions of the header 6 and the receiver 22. The gaseous phase of the refrigerant tends to circulate through upper portions of the receiver 22 while the liquid phase of the refrigerant collects at the receiver bottom, and also at the bottom of the header 6. The liquid phase of the refrigerant then enters the refrigerant transfer tubes 14 of the supercooling core 12. Here, further cooling occurs such that the refrigerant exits into the outlet side of the header 4 for passage through the outlet 20 as a supercooled liquid. As can be seen in FIG. 1, the cooling action of the condenser 2 is aided by plural cooling fins 26 placed between the refrigerant transfer tubes 10 of the condensing core 8 and the refrigerant transfer tubes 14 of the supercooling core 12. Although not shown in FIG. 1 in the interest of drawing clarity, the cooling fins 26 extend substantially the entire distance between the headers 4 and 6.

Figure 2:
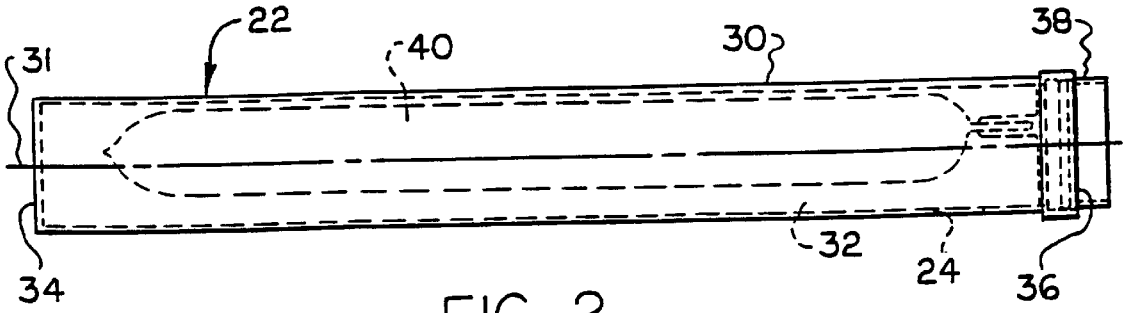
FIG. 2 is a detailed front view of the elongated housing of FIG. 1 showing the housing, an elongated adsorbent unit therein, and a housing end cap that is connected to the adsorbent unit.
Figure 3:
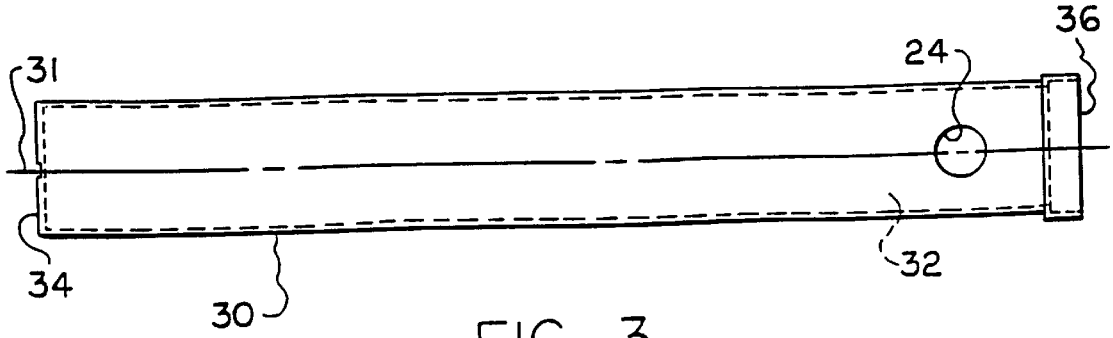
FIG. 3 is a detailed side view of the elongated housing in FIG. 1 taken in the direction of arrows 3—3 in FIG. 1, and showing the housing only without the absorbent unit or the end cap of FIG. 2.
Figures 4, 5, 6:
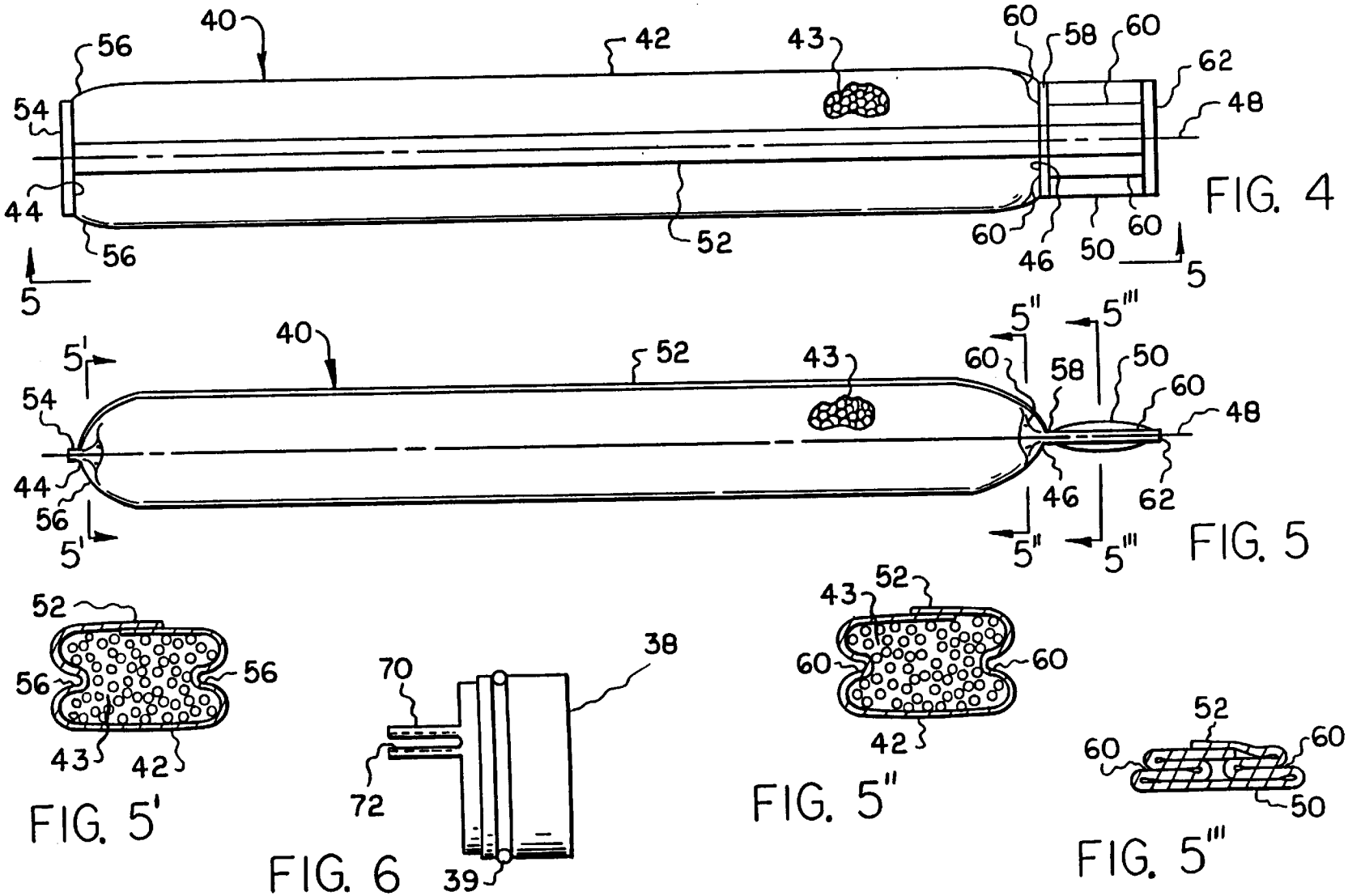
FIG. 4 is a plan view of the adsorbent unit of FIGS. 2 and 3, which is constructed in accordance with the present invention.
FIG. 5 is a side elevational view of the adsorbent unit of FIG. 4 taken in the direction of arrows 5—5 in FIG. 4.
FIG. 6 is a side elevational view of the housing end cap of FIG. 2.

Turning now to FIGS. 2 and 3, the receiver 22 is constituted as an elongated metal housing 30 that is preferably cylindrical but which could be formed with noncircular cross-sectional shapes as well. The housing 30 has a length-to-width ratio of not less than about 6:1. It includes a central longitudinal axis 31 and defines an adsorbent unit receiving chamber 32 extending between a closed end 34 and an open end 36. The open end 36 receives an end cap 38 that is made from plastic (e.g., polyester or polypropylene), metal or other suitable material. The end cap 38 can be secured to the open end 36 in conventional fashion. For example, the end cap 38 can be threaded into the open end 36, or clamped thereto, or secured in any other suitable manner that permits relatively rapid detachment of the end cap 38 from the open end 36. The end cap 38 can also be more permanently attached, as by welding, brazing or the like. As shown in FIG. 6, an O-ring 39 provides a seal between the open end 36 and the end cap 38 to prevent refrigerant leakage.

Disposed within the elongated housing 30, and connected to the end cap 36, is a self-retaining elongated adsorbent unit 40. The adsorbent unit 40 preferably has a cross-sectional shape that matches that of the housing 30 and has a length-to-width ratio of not less than about 6:1. It has a smaller girth than the cross-sectional area of the chamber 32, but preferably occupies a substantial portion of the cross-sectional area of the chamber 32; for example, not less than about 50% of such area. The function of the adsorbent unit 40 is to remove moisture from the refrigerant that enters the receiver 22 from the condenser header 6 (see FIG. 1). The receiver 22 provides a refrigerant accumulating area where the moisture removal function can be performed. This area also allows gaseous refrigerant to accumulate and condense into liquid form. By making the adsorbent unit 40 smaller than the receiver chamber 32, the refrigerant is allowed to flow freely through the receiver 22. However, by sizing the girth of the adsorbent unit 40 to occupy not less than about 50% of the cross-sectional area of the chamber 32, enough adsorbent material can be placed therein to adequately perform the moisture adsorbing function. Moreover, the adsorbent unit 40 stands less chance of being damaged or bound up in the receiver 22 due to refrigerant flow surges during refrigeration unit power-up.

Turning now to FIGS. 4 and 5, the adsorbent unit 40 is formed as an elongated adsorbent-carrying porous fabric casing 42 having an adsorbent 43 disposed therein. The casing can be made from a variety of porous fabrics but the preferred material is felted polyester. The adsorbent 43 disposed within the casing 42 can be selected from any of a variety of suitable adsorbent materials but is preferably a molecular sieve. The casing 42 is packed with a sufficient amount of the adsorbent 43 so as to retain the shape shown in FIGS. 4 and 5 when the adsorbent unit 40 is in the upright position of FIG. 1, extending upwardly from the end cap 38.

By virtue of the casing construction described in more detail below, the casing 42 is rendered substantially cylindrical in shape when packed with a sufficient amount of the adsorbent 43 to cause the casing to retain the shape shown in FIGS. 4 and 5, as noted above. This cylindrical shape extends from a base end 44 to a tab transition end 46, with the cylinder being centered on a longitudinal axis 48. The adsorbent unit 40 further includes a generally planar tab 50 extending from the transition end 46 of the casing 42 and in substantial alignment with the longitudinal axis 48. As can be seen in FIG. 4, the width of the tab 50 throughout its length is substantially equal to the diameter of the casing 42.

The adsorbent unit 40 can be constructed in a variety of ways. By way of example only, the elongated sides of an elongated sheet of felted polyester fabric may be brought together in slightly overlapping relationship and fused along the entire length of the sheet by ultrasonic welding, heat sealing or any other suitable method, to form a fused longitudinal seam 52 that runs parallel to the longitudinal axis 48. To facilitate this seam formation, the fabric sheet can be wrapped around a suitable mandrel structure (not shown) so that the opposite side of the casing 42 is isolated from the area of longitudinal seam formation.

The base end 44 of the casing 42 can next be formed by creating a fused transverse seam 54 extending transversely to the longitudinal axis 48. Prior to forming the transverse seam 54, and to assist in producing the cylindrical shape of the casing 42, a pair of tucks 56 (see FIG. 5') can be made on opposing sides of the longitudinal seam 52, adjacent to the base end portion of the casing 42.

After formation of the transverse seam 54 to produce the base end 44, the casing 42 can be filled with the above-described adsorbent 43. To close the remaining open end of the casing 42 to prevent loss of the absorbent 43, a second fused transverse seam 58 is created extending transversely to the longitudinal axis 48. The seam 58 forms the casing's tab transition end 46. Again, prior to forming the transverse seam 58, and to assist in producing the cylindrical shape of the casing 42, a pair of tucks 60 (see FIG. 5") can be made on opposing sides of the longitudinal seam 52, beginning adjacent to where the transverse seam 58 will be formed.

Forming the transverse seam 58 completes the casing 42 and creates a transition end the tab 50. The tab 50 is completed at its free end by forming a third fused transverse seam 62 that extends transversely to the longitudinal axis 48. The seams 58 and 62 tend to flatten out the tubular shape of the portion of the casing 42 that forms the tab 50, such that the tab 50 is rendered substantially planar. It will be appreciated that the tab 50 will comprise at least two layers of the material sheet used to form the casing 42. In addition, as shown in FIGS. 4 and 5, the tucks 60 can be formed so as to extend to the end seam 62, such that the tab 50 has at least four layers of sheet material in the vicinity of the longitudinal seam 52 (see FIG. 5'").

In the discussion which follows, a number of alternative constructions are shown for connecting the tab 50 of the adsorbent unit 40 to the end cap 38. As indicated by way of background above, it is desirable to be able to readily remove an adsorbent unit from a receiver housing for replacement, yet retain the adsorbent unit in a relatively fixed position when it is in service. For example, in the receiver 22 of FIG. 1, the adsorbent unit 40 could easily block the refrigerant opening 24' if the adsorbent unit was not adequately secured within the receiver. In some of the connection examples described below, the tab 50 is advantageously connected to the end cap 38 so that the adsorbent unit 40 is removed from the receiver 22 simply by removing the end cap. It is then relatively easy to disconnect the tab 50 from the end 38 and attach a new adsorbent unit. In other connection examples described below, the tab 50 connects to an insert that is either mounted to the end cap 38 or is elongated so as to present itself for grasping after the end cap is removed from the receiver housing 30. No complicated receiver disassembly or cage removal operations are necessary to replace the adsorbent.

Figure 7:
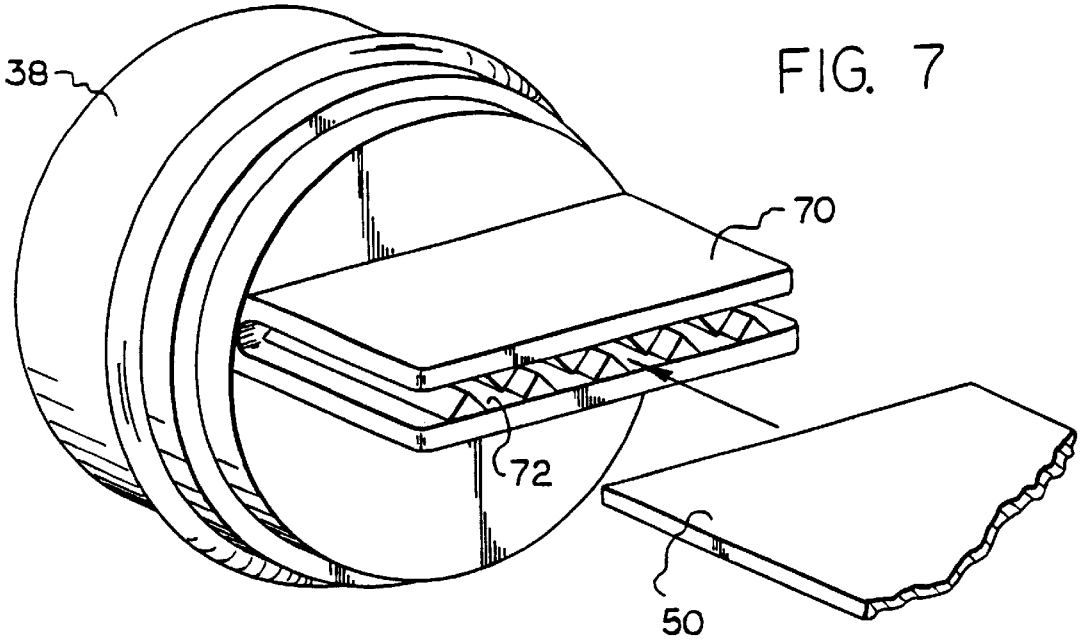
FIG. 7 is an exploded perspective view showing a retaining tab of the adsorbent unit approaching the end cap to form a connection.

Turning now to FIGS. 6 and 7, a connection for use in securing the adsorbent unit 40 to the end cap 38 may be constructed in accordance with one embodiment of the invention by forming the end cap 38 with an axially extending connecting member 70. The connecting member 70 includes a slot 72 that is sized to receive the tab 50 of the adsorbent unit 40. If the end cap 38 is made from plastic, the opposing inner walls of the slot 72 can be formed with energy directors 74 (see FIG. 7) to facilitate ultrasonic welding of the adsorbent unit tab 50 to the connecting member 70. If the end cap 38 is made from metal, the connecting member can be crimped to the tab 50. It should be noted that FIGS. 6 and 7 (as well as FIG. 2) illustrate the connecting member 70 being situated in an off-center location relative to the axial centerline of the end cap 38. This design positions the adsorbent unit 40 on one side of the receiver 22 to ensure there is enough spacing between the adsorbent unit and the receiver so that refrigerant can circulate throughout the full length of the receiver, as noted above. In alternative constructions, it may be desirable to position the connecting member 70 and the adsorbent unit 40 in a more central location, according to design objectives.

Figure 8:
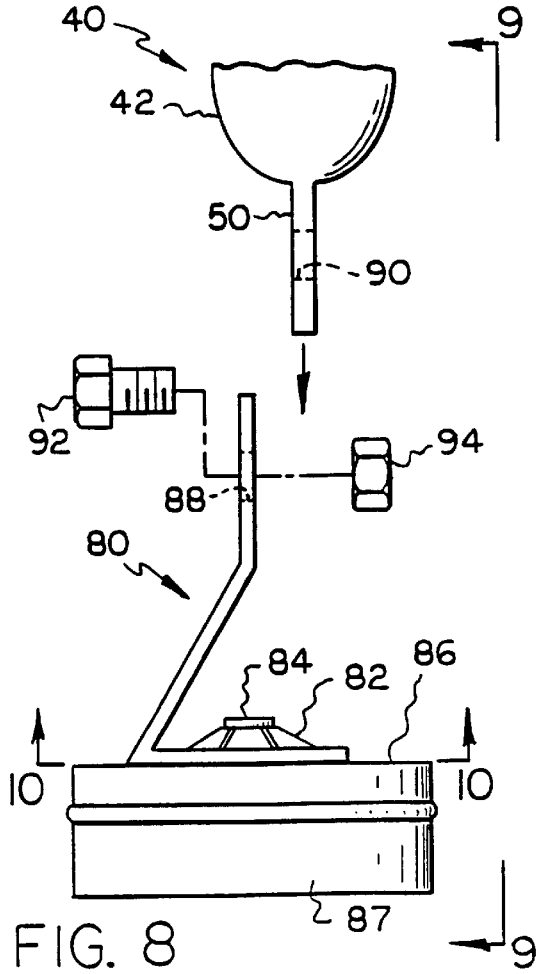
FIG. 8 is a side elevational view showing the retaining tab approaching the end cap to form another type of connection between the retaining tab and the end cap.
Figure 9:
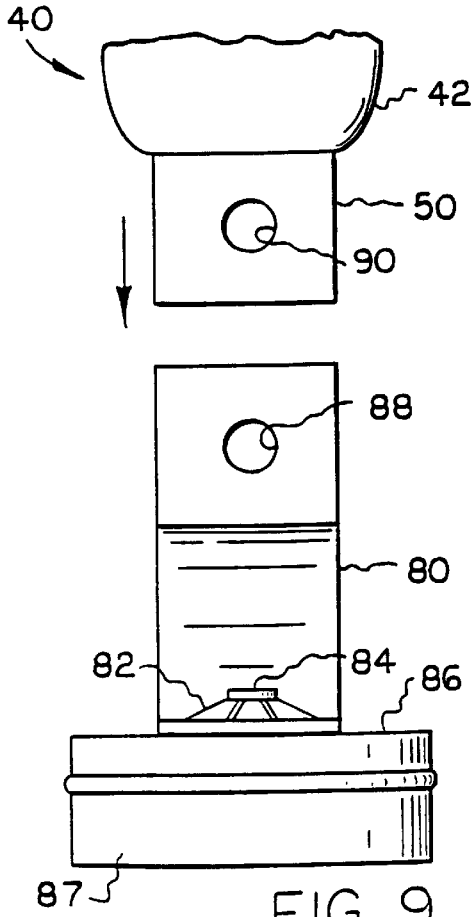
FIG. 9 is a view taken substantially in the direction of arrows 9—9 of FIG. 8.

Turning now to FIGS. 8–10, another embodiment of the invention is shown wherein a polyester or polypropylene plastic or metal connecting bracket 80 is attached to the end cap 38. The connecting bracket 80 can be attached to the end cap 38 in a variety of ways, such as by forming the connecting bracket with an integral spring clip retainer 82 that mounts on a boss 84 formed on the inner face 86 of a modified end cap 87. The connecting bracket 80 and the tab 50 can be formed with respective holes 88 and 90 for receiving a suitable fastener, such as a bolt 92 and washer 94, for joining the tab 50 to the connecting bracket 80.

Turning now to FIG. 11, another arrangement for joining a modified tab 50' of a casing 42' to the connecting bracket 80 is shown in accordance with the present embodiment of the invention. This connection can be used most advantageously when the tab 50' is constructed without the tucks 60 (see FIG. 5'") extending therein and without the transverse seam 62. Instead, the tab 50' will consist of opposing side portions **50*a* and 50*b* of the casing 42, which are flattened by virtue of the transverse seam 58 but which remain separated at the end of the tab 50', thus forming an open pocket 90 for receiving the connecting bracket 80. In order to join the tab 50' to the connecting bracket 80, the tab portions 50*a* and 50*b* can be spot welded at 86 (using ultrasonic welding, heat sealing or any other suitable method) to fuse the side portions 50*a* and 50*b* together through the connecting bracket hole 84**.

Turning now to FIG. 12, another embodiment of the invention is shown wherein the tab 50 is connected directly to the inner face 100 of a modified end cap 101. In particular, the inner face 100 can be formed with a threaded bore 102 for receiving a fastener, such as the bolt 104, that extends through a hole 106 formed in the tab 50.

Turning now to FIGS. 13–14, another embodiment of the invention is shown wherein the tab 50 is connected to a boss 110 that is formed on a flange 112 extending from the inner face 114 of a modified end cap 115. A hole 116 is formed in the tab 50 to receive the boss 110. An appropriate retainer, such as a polyester or polypropylene plastic or metal spring clip retainer 118, can be mounted on the boss 110 to secure the tab 50 against the flange 112.

Turning now to FIGS. 15–16, another embodiment of the invention is shown wherein the tab 50 is connected to a boss 120 that is integrally formed on the inner face 122 of a modified end cap 123. A hole 124 is formed in the tab 50 to receive the boss 120. An appropriate retainer, such as a polyester or polypropylene plastic or metal spring clip retainer 126, can be mounted on the boss 120 to secure the tab 50 against the inner face 122.

Figure 17:
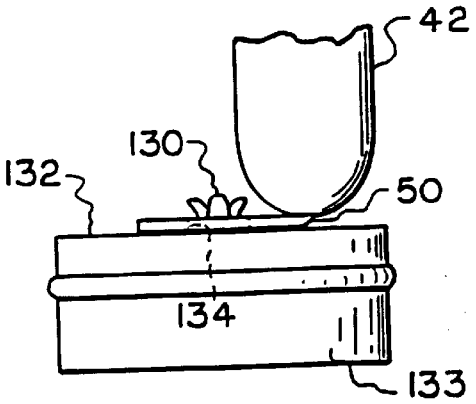
FIG. 17 is a side elevational view showing another type of connection between the retaining tab and the end cap.
Figure 18:
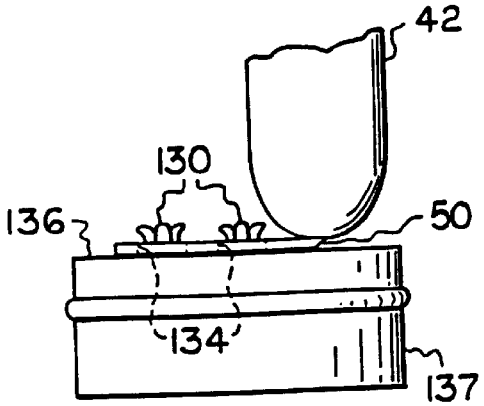
FIG. 18 is a side elevational view showing a modification of the connection of FIG. 17.

Turning now to FIGS. 17–18, another embodiment of the invention is shown in two alternate arrangements. In FIG. 17, a metal swaging boss 130 is formed on (or mounted to as a separate swaging fastener) the inner face 132 of a modified end cap 133. A hole 134 is formed in the tab 50 to receive the boss 130, which is then swaged to secure the tab. In FIG. 18, two metal swaging bosses 130 are formed on (or mounted to as separate swaging fasteners) the inner face 136 of a modified end cap 137. Two holes 138 are formed in the tab 50 to receive the bosses 130, which are then swaged to secure the tab.

Figure 20:
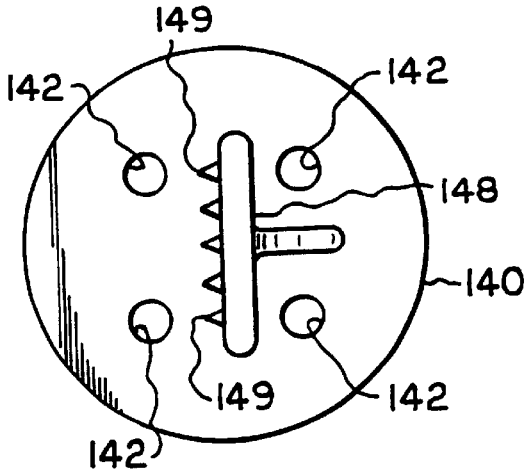
FIG. 20 is a plan view of the insert used in the connection of FIG. 19.
Figure 19:
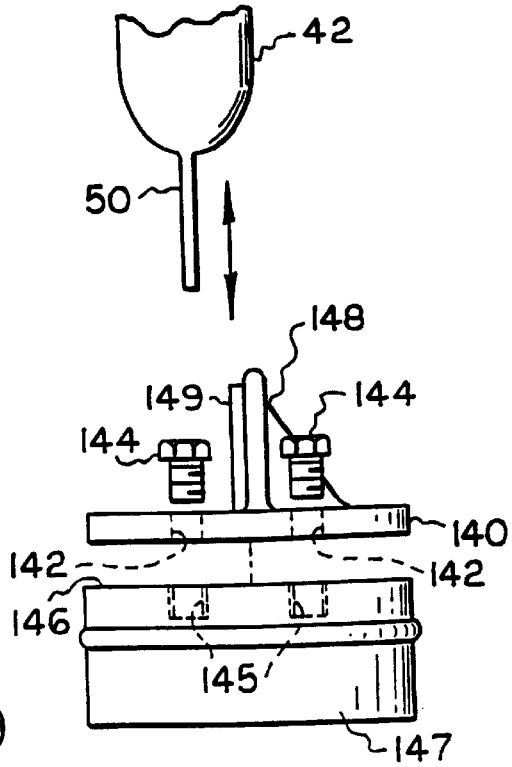
FIG. 19 is an exploded view showing a connection between the retaining tab and a receiver insert which is to be located proximate to the end cap.

Turning now to FIGS. 19 and 20, another embodiment of the invention is shown wherein the tab 50 is connected to an insert 140 that is mounted to the end cap 38. The insert 140 may be formed from any suitable material, such as polyester or polypropylene plastic. It includes four holes 142 that receive suitable fasteners, such as bolts 144. The bolts 144 are received in threaded holes 145 formed in the inner face 146 of a modified end cap 38 147. The insert 140 further includes a gusseted flange 148 having energy directors 149 for fusing (e.g., via welding) the adsorbent unit tab 50 to the insert.

Figure 21:
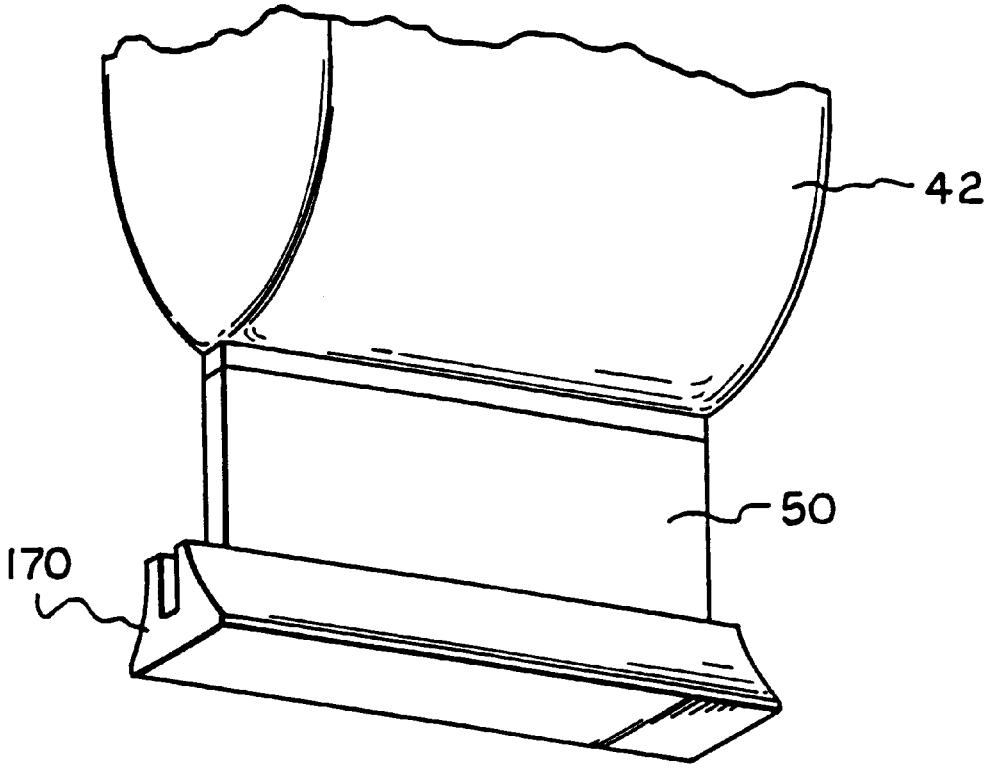
FIG. 21 is a perspective view of an adsorbent unit with a connector attached to the retaining tab for connecting to the end cap.
Figure 22:
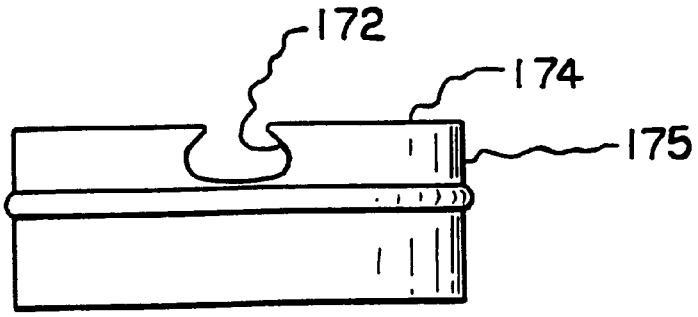
FIG. 22 is a side elevational view of the end cap adapted to receive the connector of FIG. 21.

Turning now to FIGS. 21–22, another embodiment of the invention is shown wherein the tab 50 is attached to a transversely-extending connector 170. The connector 170 can be made from any suitable material, such as polyester or polypropylene plastic or metal. A mating channel 172 is formed in the inner face 174 of a modified end cap 175. The channel 172 is adapted to slidably receive the connector 170, thereby completing the connection of the tab 50 to the end cap 175.

Accordingly, a self-retaining elongated adsorbent unit has been shown and described. While various embodiments have been disclosed, it should be apparent that many variations and alternative embodiments would be apparent to those skilled in the art in view of the teachings herein.

What is claimed is:

1. In an elongated refrigerant receiver housing, a self-retaining adsorbent unit comprising: an elongated adsorbent-carrying porous fabric casing having a length-to-width ratio of not less than about 6:1; adsorbent disposed in said casing; and a retaining tab formed at one end of said casing.

2. In an elongated refrigerant receiver housing as set forth in claim 1 wherein said casing has a longitudinal axis and said tab is substantially aligned with said axis.

3. In an elongated refrigerant receiver housing as set forth in claim 1 wherein said tab is formed by an extension of the material used to form said casing.

4. In an elongated refrigerant receiver housing as set forth in claim 1 wherein said tab is substantially flat.

5. In an elongated refrigerant receiver housing as set forth in claim 1 wherein said tab is formed as a multi-ply material sheet.

6. In an elongated refrigerant receiver housing as set forth in claim 5 wherein a pocket is formed between two plies of said multi-ply material sheet.

7. In an elongated refrigerant receiver housing as set forth in claim 1 wherein said casing has a substantially cylindrical shape and a pair of tucks are formed at said end of said casing where said tab is formed in order to maintain said substantially cylindrical shape.

8. In an elongated refrigerant receiver housing as set forth in claim 1 wherein said tab includes an aperture.

9. An adsorbent unit comprising a porous fabric casing, adsorbent in said casing, said casing being elongated and having a length-to-width ratio of at least about 6:1, and a tab extending outwardly from one end of said casing.

10. An adsorbent unit as set forth in claim 9 wherein said tab is of a width that is substantially equal to the width of said casing.

11. An adsorbent unit as set forth in claim 9 wherein said adsorbent unit is packed sufficiently tightly within said casing to cause said adsorbent unit to be self-sustaining.

12. An adsorbent unit as set forth in claim 9 in combination with an elongated tube in which said adsorbent unit is mounted, wherein said adsorbent unit occupies at least about 50% of the cross-sectional area of said elongated tube.

13. An adsorbent unit as set forth in claim 9 wherein said adsorbent unit has a longitudinal axis, and wherein said tab is positioned substantially along said longitudinal axis.

14. An adsorbent unit as set forth in claim 13 wherein said casing is fabricated from a single piece of fabric having a seam extending longitudinally thereof.

15. An adsorbent unit as set forth in claim 9 wherein said tab includes an aperture.

16. An adsorbent unit comprising an elongated porous fabric casing having a length to width ratio of at least 6:1, adsorbent in said casing, first and second closed ends on said casing, a tab extending outwardly beyond said first closed end, and at least one tuck in said casing proximate said first closed end.

17. An adsorbent unit as set forth in claim 16 including at least one tuck in said casing proximate said second closed end.

18. An adsorbent unit as set forth in claim 16 wherein said casing is substantially cylindrical in shape substantially throughout its length.

* * * * *